US007179577B2

(12) United States Patent
Matsuda et al.

(10) Patent No.: US 7,179,577 B2
(45) Date of Patent: Feb. 20, 2007

(54) CARRIER FOR DEVELOPER FOR DEVELOPING ELECTROSTATIC LATENT IMAGE, IMAGE FORMING METHOD USING SAME AND IMAGE FORMING APPARATUS USING SAME

(75) Inventors: Hiroaki Matsuda, Numazu (JP); Fumihiro Sasaki, Fuji (JP); Hiroyuki Yoshikawa, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/282,623

(22) Filed: Nov. 21, 2005

(65) Prior Publication Data

US 2006/0073405 A1 Apr. 6, 2006

Related U.S. Application Data

(62) Division of application No. 10/086,683, filed on Mar. 4, 2002.

(30) Foreign Application Priority Data

Mar. 2, 2001 (JP) ..... 2001-059113

(51) Int. Cl.
*G03G 21/10* (2006.01)

(52) U.S. Cl. ..... 430/125; 399/356

(58) Field of Classification Search ..... 430/125, 430/111.35; 399/356
See application file for complete search history.

(56) References Cited

U.S. PATENT DOCUMENTS

| | | | | |
|---|---|---|---|---|
| 4,040,969 | A | 8/1977 | Jones | |
| 4,426,247 | A * | 1/1984 | Tamamura et al. | 438/702 |
| 4,681,426 | A * | 7/1987 | Bean et al. | 430/125 |
| 5,102,767 | A * | 4/1992 | Chowdry et al. | 430/126 |
| 5,204,204 | A | 4/1993 | Shintani et al. | |
| 5,390,015 | A * | 2/1995 | Nagame et al. | 399/356 |
| 5,496,673 | A * | 3/1996 | Saitoh et al. | 430/111.3 |
| 5,849,448 | A | 12/1998 | Yoshino et al. | |
| 6,074,795 | A | 6/2000 | Watanabe et al. | |
| 6,103,441 | A | 8/2000 | Tomita et al. | |
| 6,168,894 | B1 | 1/2001 | Aoki et al. | |
| 6,180,298 | B1 | 1/2001 | Kuroda et al. | |
| 6,258,502 | B1 | 7/2001 | Nakamura et al. | |
| 6,335,137 | B1 | 1/2002 | Suzuki et al. | |
| 6,337,957 | B1 | 1/2002 | Tamaki et al. | |
| 6,360,068 | B1 | 3/2002 | Kinoshita et al. | |
| 6,363,229 | B1 | 3/2002 | Shiraishi et al. | |
| 6,395,443 | B2 | 5/2002 | Kuroda et al. | |
| 6,403,275 | B1 | 6/2002 | Kuramoto et al. | |
| 6,406,826 | B1 | 6/2002 | Suzuki et al. | |
| 6,432,589 | B1 | 8/2002 | Uchinokura et al. | |
| 6,442,364 | B2 | 8/2002 | Kai et al. | |
| 6,468,706 | B2 | 10/2002 | Matsuda et al. | |
| 6,500,594 | B2 | 12/2002 | Hamano et al. | |
| 6,505,014 | B2 | 1/2003 | Aoki et al. | |
| 6,507,718 | B2 | 1/2003 | Ohjimi et al. | |
| 6,534,232 | B1 | 3/2003 | Matsuda et al. | |
| 6,579,653 | B1 | 6/2003 | Yuasa et al. | |

FOREIGN PATENT DOCUMENTS

| | | | |
|---|---|---|---|
| EP | 086444 | A | 8/1983 |
| JP | 0621236 | A | 10/1994 |
| JP | 2001027829 | A | 1/2001 |
| WO | 00/52533 | A | 9/2000 |

OTHER PUBLICATIONS

Donnet et al. Carbon Black: Physics, Chemistry, and Elastomer Reinforcement. New York: Marcel-Dekker, Inc. (1976) p. 1.
Diamond, Arthur S. Handbook of Imaging Materials. New York: Marcel-Dekker, Inc. (1991) pp. 222-224.
Diamond, Arthur S. (editor) Handbook of Imaging Materials. New York: Marcel-Dekker, Inc. (1991) pp. 162-170.
Kirk-Othmer Consise Encyclopedia of Chemical Technology. New York: John-Wiley & Sons. (1985) p. 1064.

* cited by examiner

*Primary Examiner*—Christopher Rodee
(74) *Attorney, Agent, or Firm*—Oblon, Spivak, McClelland, Maier & Neustadt, P.C.

(57) ABSTRACT

A carrier for an image developer for electrophotography, including core particles, and a coating layer covering each of the core particles, wherein the core particles have a weight average particle diameter of Dv which is 25–45 μm and a number average particle diameter of Dp which meets with the following condition:

$$1 \leq Dv/Dp \leq 1.3,$$

wherein the core particles have such a particle size distribution that particles having a particle diameter of less than 44 μm is at least 70% by weight and particles having a particle diameter of less than 22 μm is not more than 7% by weight.

5 Claims, 2 Drawing Sheets

CARRIER FOR DEVELOPER FOR DEVELOPING ELECTROSTATIC LATENT IMAGE, IMAGE FORMING METHOD USING SAME AND IMAGE FORMING APPARATUS USING SAME

The present application is a Divisional Application of U.S. patent application Ser. No. 10/086,683, filed on Mar. 4, 2002.

BACKGROUND OF THE INVENTION

This invention relates to a carrier for an image developer, to an electrostatic latent image developer, to an image forming apparatus by electrophotography, electrostatic recording, electrostatic printing, etc., and to an image developing method by electrophotography, electrostatic recording, electrostatic printing, etc.

Conventionally a cascade development method as disclosed in U.S. Pat. No. 2,618,552 and a magnetic brush development method as disclosed in U.S. Pat. No. 2,874,063 are known as methods for developing latent electrostatic images to visible images by use of toner. In any of these development methods, a dry two-component developer is employed.

Such a dry two-component developer is composed of relatively large carrier particles and fine toner particles which are triboelectrically held on the surface of the relatively large carrier particles by the electric force generated by the friction between the carrier particles and toner particles. When such a dry two-component developer is brought into contact with latent electrostatic images, the toner particles are attracted to the latent electrostatic images, with the bonding force between the carrier particles and the toner particles being overcome by the attracting force of the electric field formed by the latent electrostatic images for bringing the toner particles towards the electrostatic images, so that the toner particles are deposited on the latent electrostatic images, whereby the latent electrostatic images are developed to visible toner images. For the above-mentioned development, it is necessary that the toner particles be provided with accurate chargeability and charge quantity so as to be selectively attracted to the desired image area formed on a photoconductor.

In conventional developers, during the process of making a number of copies, there takes place a so-called "spent phenomenon" that a toner film is formed on the surface of the carrier particles as a result of collision between the toner particles and the carrier particles and collision between such developer particles and mechanical portions of a development unit, so that the charging performance of the carrier particles is decreased. This will result in deposition of the toner particles on the background of the images and of lowering of the copy quality. When the filming phenomenon excessively develops, there occurs the case where the developer must be exchanged with fresh one in its entirety, which will lead to an increase in the copy making costs.

To cope with the spent phenomenon, various methods have been proposed in which surfaces of carrier particles are coated with a resin having low surface energy. These methods, however, are not fully satisfactory. For example, a carrier coated with a styrene resin, a methacrylate copolymer resin or a styrene resin, which has a relatively high critical surface tension, still causes a spent phenomenon upon repeated use, though the charging characteristics thereof are good. A polytetrafluoroethylene resin, which has a low critical surface tension, can improve the spent carrier problem. However, since a polytetrafluoroethylene resin is located on the most negative side of the turboelectric series, it is ill-suited for use in a developer in which the toner is to be negatively charged. Because of its low surface energy, a silicone resin is also proposed as a coating resin for carriers with a view toward the prevention of the spent-carrier problem (Japanese Examined Patent Publication No. S44-27879 and Japanese Laid Open Patent Publication No. S50-2543). While the use of a silicone resin can prevent toner deposition onto carrier surfaces, it has a problem because the mechanical strengths thereof such as wear resistance and impact resistance are not sufficient. Thus, as upon repeated collision between the toner particles and the carrier particles and collision between such developer particles and mechanical portions of a development unit, the silicone resin coating is gradually worn so that the carrier core is exposed on the surface the carrier. As a consequence, the turboelectric characteristics of the carrier becomes so unstable that the image quality produced is lowered. Additionally, carriers having a resin coating have a large resistivity and are apt to cause the so-called edge effect (a phenomenon that image density of a center part of a large solid image is lighter than that of an edge part thereof) in developed images, resulting in deterioration of the reproducibility of solid images and half-tone images.

In an attempt to solve the above problems, there is a proposal to incorporate an electroconductive material into a resin layer of carrier particles so as to reduce the electric resistivity thereof. The carrier particles imparted with a suitable degree of the electrical conductivity can serve to provide developing electrodes so that the development of an electrostatic latent image can be conducted while maintaining close contact between the electrode and the latent image. By this expedience, not only line images but also large solid images can be reproduced with good fidelity. As the electroconductive material, the use of carbon has been proposed. However, the conventional carrier having a carbon-containing resin coating has a problem that carrier deposition is not effectively prevented when the particle size of the carrier is small.

As for developers, the use of a small size toner will greatly improve the reproducibility of dot images but, in this case, occurrence of background stains and reduction of color density are caused due to the fact that the small size toner has a large surface area to be charged. To improve charging efficiency of a small size toner, the use of a small size carrier has been proposed (Japanese Laid Open Publication No. H06-332237 and Japanese Patent Nos. 2703917 and 2769894).

The use of a small size carrier will give the following merits. Because of a large surface area, every toner can be sufficiently charged by friction so that the formation of a low charging amount toner or a reversed charged toner can be minimized. Thus, background stains and toner dispersion or blurs of a dot image can be reduced so that the dot image reproducibility is improved. Further, it is possible to reduce average charging amount of the toner. As a consequence, a high image density is obtainable. The use of a small size carrier can thus compensate demerits of a small size toner and is effective for obtaining desired properties of the small size toner.

The known small size carriers, however, have the following problems, In a developing stage for developing an electrostatic image on a photoconductor drum, a carrier is magnetically held by a developing cylinder so that the carrier is not transferred to the photoconductor drum. When the particle size of the carrier is small, however, the degree of magnetization per unit weight is so small that the carrier is easily released from the magnetic field of the developing cylinder and is trapped by the photoconductor drum (phenomenon of carrier deposition or carrier attraction). Such carrier deposition occurs more frequently as the particle size of the carrier becomes small. As the carrier deposition proceeds, the amount of the carrier in the developing zone decreases. This will result in failure to sufficiently charge the toner so that background steins of images and scattering of toner particles from the developing device may occur.

SUMMARY OF THE INVENTION

It is, therefore, an object of the present invention to provide a carrier for a developer which is devoid of the drawbacks of the conventional carrier.

Another object of the present invention is to provide a carrier which can prevent occurrence of an edge effect and formation of white spots in a solid pattern.

It is a special object of the present invention to provide a small size carrier which can effectively resist against deposition thereof on an electrostatic latent image bearing member such as a photoconductor.

It is a further object of the present invention to provide an image forming method which permits production of a large number of images in a stable manner without causing background steins and scattering of toner from a developing device.

It is yet a further object of the present invention to provide an image forming apparatus which permits production of a large number of images in a stable manner without causing background steins and scattering of toner from a developing device.

In accomplishing the foregoing objects, the present invention provides a carrier for a developer for developing an electrostatic image, comprising core particles, and a resin layer covering each of said core particles and containing carbon particles having a number average particle diameter of 0.01–0.1 μm.

In another aspect, the present invention provides an image forming method comprising the steps of:

contacting an image forming member bearing an electrostatic latent image thereon with a developer according to claim 5 to develop the latent image with the developer to form a toner image on said image forming member;

transferring said toner image to a transfer member;

collecting the toner and the carrier remaining on said image forming member after the transferring step; and recycling the collected toner and the carrier for use in the contacting step.

The present invention also provides an image forming apparatus, comprising:

an image forming member adapted to bear an electrostatic latent image thereon;

means disposed adjacent to said image forming member for forming an electrostatic latent image on said image forming member;

a developing mechanism having a vessel containing a developer according to claim 5 for developing the latent image with the developer to form a toner image on said image forming member;

a transferring mechanism for transferring said toner image from said image forming member to a transfer member;

a collecting mechanism located downstream of said transferring mechanism for recovering the toner and the carrier remaining on said image forming member; and a recycling mechanism for returning the collected toner and the carrier to said vessel.

BRIEF DESCRIPTION OF THE DRAWINGS

Other objects, features and advantages of the present invention will become apparent from the detailed description of the preferred embodiments of the invention which follows, when considered in light of the accompanying drawings in which.

DETAILED DESCRIPTION OF THE PREFERRED EMBODIMENTS OF THE INVENTION

Figure 1:
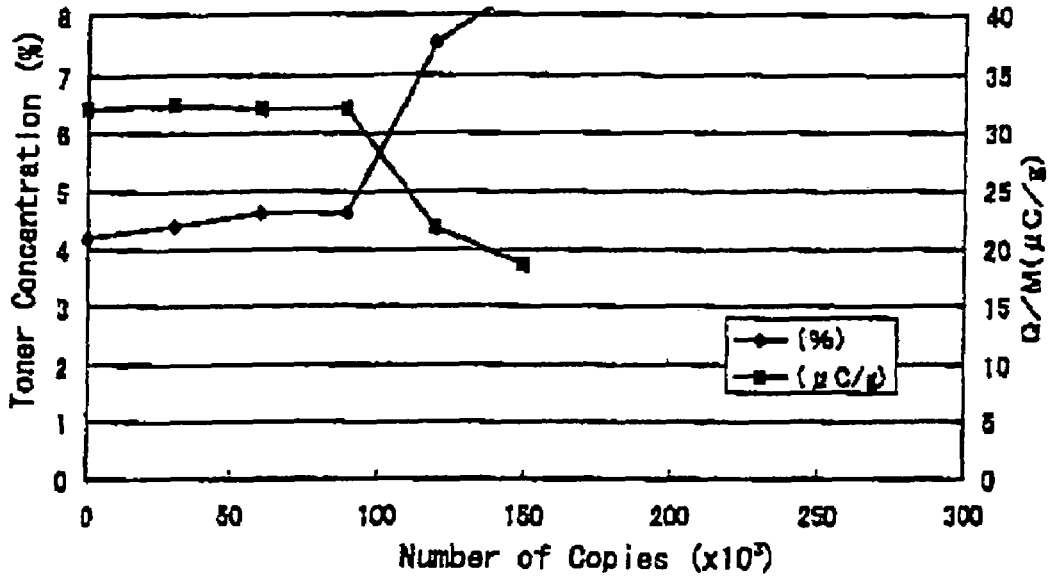
FIG. 1 shows graphs illustrating a relationship between the toner concentration and the number of copies produced and a relationship between Q/M and the number of copies produced in Example 1.

The carrier according to the present invention comprises a core material, and a coating layer covering the core material and containing carbon particles having a number average particle diameter of 0.01–0.1 μm.

Any conventionally employed core material for two-component developers may be used for the purpose of the present invention. Examples of carrier core materials include ferromagnetic materials such as iron and cobalt, magnetite, hematite, Li ferrite, Mn—Zn ferrite, Cu—Zn ferrite, Ni—Zn ferrite, Ba ferrite, Mn—Mg ferrite and Mn ferrite. Ferrite is a sintered material generally represented by the formula:

$$(MO)_x(NO)_y(Fe_2O_3)_z$$

wherein x+y+z=100 mol %, and M and N are metals such as Li, Sr, Ca, Mg, Ba, Cu, Zn, Mn, Fe, Ni and Cd.

The carrier core particles are each coated with a resin layer. Any binder customarily used for coating a core material of carriers may be employed in the present invention. Examples of the binder include tetrafluoroethylene resins, monochlorotrifluoroethylene resins, polyvinylidene fluoride resins, silicone resins, polystyrene resins (e.g. polystyrene, chloropolystyrene, poly-α-methylstyrene, styrene-chlorostyrene copolymers, styrene-propylene copolymers, styrene-butadiene copolymers, styrene-vinyl chloride copolymers, styrene-maleic acid copolymers, styrene-acrylate copolymers (acrylate may be for example methyl acrylate, ethyl acrylate, butyl acrylate, octyl acrylate or phenyl acrylate), styrene-methacrylate copolymers (methacrylate may be for example methyl methacrylate, ethyl methacrylate, butyl methacrylate, octyl methacrylate or phenyl methacrylate), styrene-methyl α-chloroacrylate copolymers and styrene-acrylonitrile-acrylate copolymers), polyester resins, acrylic resins (e.g. polyacrylic resins, polymethacrylic resins, ethylene-ethylacrylate resins and aminoacrylate resins), polyamide resins, polyvinylbutyral resins and mixtures thereof.

The preferred binder resin is a silicone resin or a mixture thereof with the above-described resins. The silicone resin may be, for example, a compound having recurring units represented by any one of the following formulas:

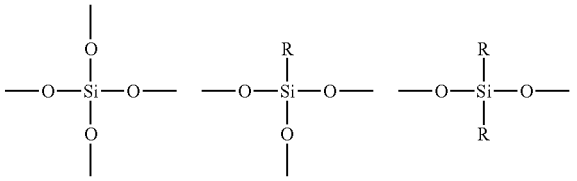

wherein R represents a hydrogen atom, a halogen atom, a hydroxyl group, a methoxyl group, a lower alkyl group having 1–4 carbon atoms or a phenyl group.

The silicone resin may be a straight silicone resin or a modified silicone resin. Specific examples of the silicone resins are silicone vanish (e.g. TSR 115, TSR 114, TSR 102, TSR 103, YR 3061, TSR 110, TSR 116, TSR 117, TSR 108, TSR 109, TSR 180, TSR 181, TSR 187, TSR 144 and TSR 165 (all products of Toshiba Silicone K. K.) and KR 271, KR 272, KR 275, KR 280, KR 282, KR 267, KR 269, KR 211 and KR 212 (all products of Shinetsu Silicone K. K.), alkyd-modified silicone vanish (e.g. TSR 184 and TSR 185 (all products of Toshiba Silicone K. K.)), epoxy-modified silicone vanish (e.g. TSR-194 and YS 54 (all products of Toshiba Silicone K. K.)), polyester-modified silicone vanish (e.g. TSR 187 product of Toshiba Silicone K. K.)), acryl-modified silicone vanish (e.g. TSR 170 and TSR 171 (all products of Toshiba Silicone K. K.)), urethane-modified silicone vanish (e.g. TSR 175 product of Toshiba Silicone K. K.)) and reactive silicone resins (e.g. KA 1008, KBE 1003, KBC 1003, KBM 303, KBM 403, KBM 503, KBM 602 and KBM 603 (all products of Shinetsu Silicone K. K.).

It is important that the coating layer for the core material contain carbon particles. Any carbon may be suitably used as long as it has a number average particle diameter of 0.01–0.1 μm. Carbon black such as furnace black, acetylene black or channel black may be suitably used. A number average particle diameter of the carbon particles less than 0.01 μm is undesirable because the electric resistance of the resulting carrier is not effectively reduced. As a consequence, an edge effect is apt to occur. On the other hand, too large a number average particle diameter of the carbon particles in excess of 0.1 μm will cause dielectric breakdown even with a low bias during developing stage. As a consequence, white spots are liable to be formed in solid images.

The amount of the carbon particles is generally 2–20% by weight based on the weight of the resin in the coating layer.

It is preferred that the carrier having the carbon-containing coating layer have a specific resistance of $10^9$–$10^{15}$ Ω·cm for reasons of obtaining satisfactory images. When the specific resistance is excessively high, it is impossible to obtain a high image density because suitable electric field for the development is not established. On the other hand, when the specific resistance is excessively small, the electrostatic latent image is apt to disappear in a case where a strong developing bias is applied. The electric resistance of the carrier may be controlled by adjusting the amount of the carbon in the resin coating layer and/or the thickness of the resin coating layer.

Incorporation of carbon particles into the resin coating layer may be carried out by, for example, dispersing the carbon particles in a coating liquid containing a binder resin using a ball mill, a beads mill or a stirrer having stirring blades, and coating the carrier core particles with the resulting coating liquid by any conventional method such as spray drying, immersion, powder coating, fluidized bed coating. The fluidized bed coating is preferably used for forming a resin layer having a uniform thickness. The coating resin layer preferably has a thickness of 0.1–1.5 μm, more preferably 0.2–1.0 μm.

It is preferred that the carrier be a small size carrier having a weight average particle diameter of 25–65 μm, more preferably 35–60 μm, most preferably 35–55 μm. It is also preferred that the carrier have such a particle diameter distribution that that portion of the carrier which has a particle diameter of less than 37 μm but no less than 26 μm accounts for 1–60%, more preferably 10–50%, most preferably 15–40%, of a total weight of the carrier for reasons of suitable charging efficiency and prevention of carrier deposition.

It is also preferred that the carrier particles provide an induced magnetic moment of 40–85 emu/g in an applied magnetic field of 1 KOe (1000 Oersteds) for reasons of formation of a magnetic brush having a desired density and prevention of scattering of the carrier particles in the developing device.

The carrier thus constructed is combined with a dry toner to form a two-component developer. In general, the toner is used in an amount of 0.5 to 15% by weight based on a total weight of the toner and the carrier. The toner is preferably a small diameter toner having a weight average particle diameter of not greater than 4.0–7.5 μm and such a particle diameter distribution that that portion of the toner having a particle diameter of 5 μm or less accounts for 60–85% based on a total particle number thereof not only for reasons of obtaining images with good reproducibility and high fidelity but also for the following reasons.

Namely, as described hereinafter, the formation of images using the above two-component developer is preferably carried out while recovering the toner and carrier remaining untransferred on the image forming member (photoconductor, for example) in a step of transferring toner images, formed on the image forming member in a developing step, to an image receiving member (an intermediate transfer medium or an image receiving paper, for example) and while recycling the recovered toner and carrier to the developing step. To perform the recovery and recycling of the toner and carrier effectively, it is desirable that the toner and the carrier have the above particle size distribution.

The toner generally contains a binder resin such as a thermoplastic resin, a coloring agent and, optionally, additive particulates such as a charge controlling agent and a releasing agent. The toner may be prepared by any suitable known method including, for example, polymerization, pulverization and classification with air classifier. Both magnetic and non-magnetic toner may be used.

The binder resins include homopolymers or copolymers of (a) styrene or styrene homologues such as styrene and chlorostyrene, (b) vinyl esters such as polyvinyl fluoride, vinyl acetate, vinyl propionate, vinyl benzoate and vinyl butyrate, (c) α-methylene aliphatic monocarboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, butyl methacrylate and dodecyl methacrylate, (d) acrylonitrile, (e) methacrylonitrile, (f) acrylamide, (g) vinyl ethers such as methyl vinyl ether, ethyl vinyl ether and i-butyl vinyl ether, (h) vinyl ketones such as methyl vinyl ketone, hexyl vinyl ketone and isopropenyl vinyl ketone and (i) N-vinyl compounds such as N-vinylpyrrol, N-vinylcarbazole, N-vinylindole and N-vinylpyrrolidone. These homopolymers and copolymers may be used singly, in combination of two or more thereof or in conjunction with a non-vinyl resin, such as a rosin-modified phenol-formalin resin, an oil-modified epoxy resin, a polyurethane resin, a polyamide resin, a cellulose resin or a polyether resin.

Illustrative of suitable coloring agents are carbon black, Lamp black, iron black, ultramarine, nigrosine, aniline blue, phthalocyanine blue, Hansa Yellow G, Rhodamine 6G, lake, Carcoyl blue, Chrome Yellow, Ultramarine yellow, methylene blue, du-Pont oil red, quinoline yellow, methylene blue chloride, Marakite green oxalate, quinacridone, Benzidine Yellow, Rose bengale, triallylmethane dyes, mono-azo or diazo pigments, and other known dyes and pigments. These materials may be used individually or in combination.

In the case of a magnetic toner, fine particles of ferromagnetic materials such as iron and cobalt, magnetite, hematite, Li ferrite, Mn—Zn ferrite, Cu—Zn ferrite, Ni—Zn ferrite, Ba ferrite and Mn ferrite may be incorporated into the toner.

For the purpose of controlling triboelectricity of the toner, a charge controlling agent may be incorporated into the toner. Examples of the charge controlling agent include organic metal complexes and chelate compounds such as a metal complex of a mono-azo dye; humic or nitrohumic acid or a salt thereof; metal complexes (e.g. Co, Cr, and Fe metal complexes) of aromatic hydroxycarboxylic or dicarboxylic acids such as salicylic acid, naphthoic acid and dicarboxylic acid; a quarternary ammonium compound; or an organic dye such as triphenylmethane dyes and nigrosine dyes.

If desired, the toner can contain a releasing agent, such as a low molecular weight polypropylene, a low molecular weight polyethylene, carnauba wax, micro-crystalline wax, jojoba wax, rice wax or montan wax.

It is desirable that the toner have sufficient fluidity and can be transferred to a latent image bearing surface without fail. To this end, a fluidity improving agent such as hydrophobic metal oxide powder (e.g. hydrophobic silica or titania), a lubricant such as organic polymer powder (e.g. polytetrafluoroethylene) or metal soap (e.g. zinc stearate), a polishing agent (e.g. cerium oxide or silicon carbide), or a caking-preventing agent may be added into the toner.

Figure 4:
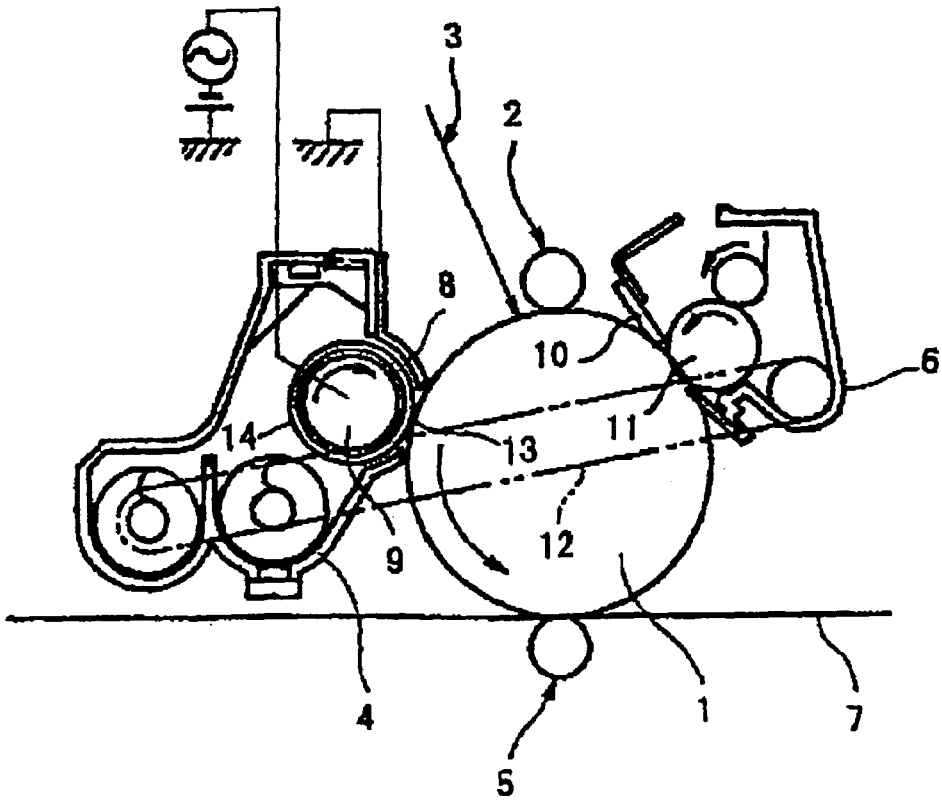
FIG. 4 is a schematic illustration of one embodiment of an image forming apparatus according to the present invention.

Referring to FIG. 4, designated as 1 is a latent image bearing member such as a photoconductor drum. Disposed adjacent to the photoconductor drum 1 are a charger 2 for charging a surface of the photoconductor drum 1 and an exposing member 3 for irradiating light on the charged surface of the drum 1 to form an electrostatic image thereon. The image bearing member 1 may be in the form of a sheet or an endless belt, if desired. The charger 2 may be conventional means such as a corotron charger, a scorotron charger, a solid state charger, and a charging roller. As the light source of the exposing member 3, there can be employed, for example, a fluorescent tube, tungsten lamp, halogen lamp, mercury vapor lamp, sodium lamp, light emitting diode (LED), semiconductor laser (LD) or electroluminescence (EL).

A developer bearing member 9 such as a developing cylinder is disposed adjacent to the latent image bearing member 1 to define a developing zone 13 therebetween, The developing cylinder 9 is adapted to carry a two-component developer 14 contained in a developer vessel 4 and to convey the developer 14 to the developing zone 13, so that the latent image on the photoconductive drum 1 is developed with the toner of the developer 14 to form a toner image.

A developer regulating member 8 such as a doctor blade is provided to regulate the amount of the developer carried and conveyed by the developing cylinder 9.

The toner image on the photoconductor drum 1 is transferred to an intermediate transfer member 7 by a transfer means 5 and the transferred image is further transferred to an image receiving member such as a paper (not shown) and is then fixed thereto by a fixing device (not shown). The intermediate transfer member 7 may be omitted and the toner image on the photoconductor drum 1 may be directly transferred to an image receiving member, if desired.

In the step of image transfer, all the toner particles deposited on the photoconductor drum 1 are not transferred to the intermediate transfer member 7. Some toner particles and carrier particles remain on the surface of the photoconductor drum 1. The remaining toner particles and carrier particles are removed from the photoconductor drum 1 using a fur brush 11 and a cleaning blade 10. The cleaning of the photoconductor may be carried out only by use of a cleaning brush. As the cleaning brush, there can be employed a conventional fur brush and magnetic fur brush, The toner particles and carrier particles thus recovered are collected in a tank 6. The collected toner and carrier may be recycled through a recycling path 12 such as a toner guide screw pipe to the developer vessel 4.

In the specification and appended claims, the number average particle diameter of carbon particles contained in the resin coating layer is as measured by the following method.

A coated carrier sample is immersed in a strong acid solution to dissolve the core material thereof. The sample from which the core material has been removed is sliced by Ultra-Microtome FC4E (manufactured by Nissei Sangyo K.K.) equipped with a cryo-sectioning system. The sliced sample is photographed with an electron microscope H-8000 manufactured by Hitachi Ltd. (magniffication: 30,000 to 50,000) at acceleration voltage of 100 kV. The image is analyzed by an image analyzer Luzex 3 manufactured by Nireco Corp. and converted into binary image data. The diameter of carbon particle is represented by a diameter of a circle having the same area as that of the carbon particle image.

In the present specification and appended claims, the particle diameter distribution of carrier particles is as measured by the following method.

Carrier particles are mixed well and 100 g of carrier particles are sampled. The sample is placed on the uppermost sieve of a plurality of stacked sieves which are set on a low tap shaker and whose openings become gradually fine in the direction from the uppermost to the lowermost. The shaker is then operated for at least 6 minutes (aimed shaking time: 8 minutes). After completion of sieving operation, particles on respective sieves are weighed down to the first decimal place. From the thus obtained results, the weight average particle diameter and the percentage of carrier particles having a particle diameter of less than 37 μm but no less than 26 μm based on the total weight of the carrier particles are calculated.

In the present specification and claims, the magnetic characteristics of the carrier (saturation magnetization) in an applied magnetic field of 1 KOe is measured using the following instrument.

(1) DC magnetization characteristic automatic recording device ("TYPE-3257-36", made by Yokokawa Hokushin Denki Co.)

(2) Electromagnet magnetizer ("TYPE-3261-15", made by Yokokawa Hokushin Denki Co.)

(3) Pickup coil (Bi & H coil, "TYPE-3261-20", made by Yokokawa Hokushin Denki Co.)

(4) Sample cell (made of acrylic resin)

(5) Electric balance (minimum graduation: 1 mg)

In the present specification and appended claims, the specific resistance of the carrier is as measured by the following method.

Figure 3:
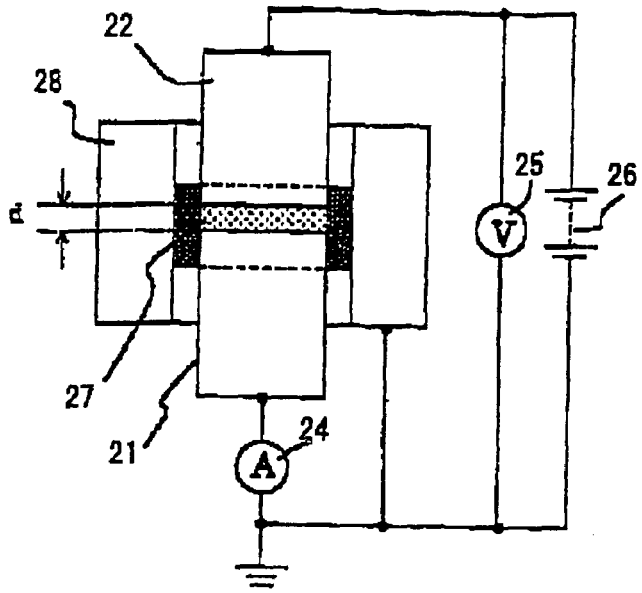
FIG. 3 is a cross-sectional view diagrammaticaly illustrating a device used for measuring electric resistance of carrier particles.

A device as shown in FIG. 3 is used. Designated as 21 and 22 are lower and upper electrodes disposed in a cell (not shown). A carrier sample 27 is disposed between the electrodes 21 and 22. A load of 275 g is applied to the upper electrode 22. Designated as 28 is a cell holder. The thickness (d) of the sample 27 is about 2 mm and the contact area between the sample 27 and each electrode is about 4.0 $cm^2$. A voltage of 500 V from a voltage source 26 is applied between the upper and lower electrodes 22 and 21 and the current value is read by an amplifier 24 to determine the specific resistance (Ω·cm) of the sample. Designated as 25 is a voltmeter.

As used herein, the particle diameter distribution of toner is measured by the following method.

The particle diameter distribution of the toner is measured with a Coulter counter (Model TA-II manufactured by Coulter Electronics, Inc.) or a Coulter Multisizer (Model II manufactured by Coulter Electronics, Inc.). As an electrolytic solution for measurement, an aqueous 1% by weight NaCl solution of first-grade sodium chloride is used. Measurement is carried out by adding, as a dispersant, 0.1–5 ml of a surfactant (alkylbenzenesulfonic acid salt) to 100 to 150 ml of the above electrolytic solution, and further adding 2 to 20 mg of a sample to be measured. The resulting mixture is subjected to dispersion for about 1 minute to about 3 minutes in an ultrasonic dispersing machine. Using an aperture of 100 μm in the above particle size distribution measuring device, the particle size distribution is measured on the basis of the number and volume with the Coulter counter for particles having a diameter in the range of 2–40.30 μm to determine the number average particle diameter and volume average particle diameter of the toner. The following 13 channels are used: 2.00 to less than 2.52, 2.52 to less than 3.17, 3.17 to less than 4.00, 4.00 to less than 5.04, 5.04 to less than 6.35, 6.35 to less than 8.00, 8.00 to less than 10.08, 10.08 to less than 12.70, 12.70 to less than 16.00, 16.00 to less than 20.20, 20.20 to less than 25.40, 25.40 to less than 32.00, 32.00 to less than 40.30.

In the present specification, the number average molecular weight Mn of toner is measured by gel permeation chromatorgraphy (GPC) under the following conditions:

Device: GPC-150C (manufactured by Waters Inc.)

Column: KF801-807 (manufactured by Showdex Inc.)

Temperature: 40° C.

Solvent: tetrahydrofuran (THF)

Elution rate: 1.0 mL/minute

Sample concentration: 0.05–0.6%

Sample amount: 0.1 ml (calibrated by polystyrene standards

The following examples will further illustrate the present invention. Parts are by weight.

EXAMPLE 1

Preparation of Coating Liquid (I) for Carrier:

Dimethylsilicone Resin Having Constituting Units of the Formula (1) Below

| | |
|---|---|
| (toluene solution, solid matter: 20%) | 600 parts |
| Toluene | 600 parts |

-continued

| | |
|---|---|
| γ-aminotriethoxysilane (KBE903 manufactured by Shin-Etsu Chemical Co., Ltd.) | 9.7 parts |
| Carbon black (BP-2000, manufactured by Cabot Company Ltd.) | 10.2 parts |

(1)

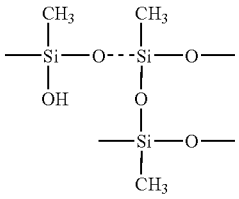

The above components were mixed and thoroughly dispersed with a homomixer (jacket temperature: 35–40° C.) for 20 minutes to obtain Coating Liquid (I) comprising a crosslinked silicone resin.

Preparation of Carrier (I):

| | |
|---|---|
| Ferrite carrier core material (I) shown below | 5000 parts |
| Coating Liquid (I) above | 1220 parts |
| Tin catalyst $(CH_3H_7)_2Sn(OCOCH_3)_2$ (10% toluene solution) | 16.8 parts |

The above ferrite carrier core material was placed on a rotary bottom disc of a fluidized bed of a coating device. The disc was rotated to form a vortex. When the vortex was stabilized, Coating Liquid (I) was sprayed into the vortex. The temperature within the coating device was set to 70° C. The resulting coated carrier was heated at 300° C. for 2 hours in an electric oven to obtain carrier (I) having a specific resistance of $2.0\times10^{13}$ Ω·cm. Carrier (I) contained carbon particles having a number average particle diameter of 0.04 μm.

The ferrite core material (I) had a weight average particle diameter of 48 μm, saturation magnetization of 91.4 emu/g, residual magnetization of 80.0 G, a coercive force of 12.5 Oe, an apparent density of 2.63 g/$cm^3$ and fluidity of 27.2 sec/50 g.

Preparation of Toner (I):

| | |
|---|---|
| Polyester resin 1 (acid value: 27.1 mg KOH/g, softening point: 147.2° C., Tg: 60.4° C., THF insoluble: 27.1% by weight) | 60 parts |
| Polyester resin 2 (acid value: 9.5 mg KOH/g, softening point: 100.2° C., Tg: 62.4° C., THF insoluble: 0% by weight) | 40 parts |
| Carnauba wax (melting point: 82° C., acid value: 2) | 3 parts |
| Carbon black (tradenamed as #44, manufactured by Mitsubishi Chemical Corp.) | 8 parts |
| Chromium-containing monoazo complex | 3 parts |

The above components were mixed using a Henschel mixer. The mixture was heated at a temperature of from 130 to 140° C. and kneaded for about 30 minutes using a roll mill. The kneaded mixture was cooled, pulverized using a jet mill and classified. The thus obtained mother toner had a number average molecular weight Mn of 2,600 and such a molecular weight distribution that that portion of the toner having a molecular weight of 1,000 or less accounts for 42% based on a total molecular number thereof. To the mother toner particles (100 parts), 1.5 parts of hydrophobic silica (R972 manufactured by Nihon Aerosil Inc.) as an external additive, mixed using Henschel mixer and classified to remove large particles, thereby obtaining Toner (I) having a number average particle diameter of 4.4 μm and a weight average particle diameter of 5.7 μm. The particle size distribution of Toner (I) measured by TA-II is shown in Table 1.

TABLE 1

| Channel | Diameter Range | Number of Particles | Number Distribution | Volume Distribution |
|---|---|---|---|---|
| 1 | 1.26–1.59 | 0 | 0.00 | 0.00 |
| 2 | 1.59–2.00 | 0 | 0.00 | 0.00 |
| 3 | 2.00–2.52 | 2045 | 6.82 | 0.68 |
| 4 | 2.52–3.17 | 3390 | 11.30 | 2.26 |
| 5 | 3.17–4.00 | 6913 | 23.04 | 9.23 |
| 6 | 4.00–5.04 | 8704 | 29.01 | 23.25 |
| 7 | 5.04–6.35 | 6509 | 21.70 | 34.77 |
| 8 | 6.35–8.00 | 2135 | 7.12 | 22.81 |
| 9 | 8.00–10.1 | 285 | 0.95 | 6.09 |
| 10 | 10.1–12.7 | 17 | 0.06 | 0.73 |
| 11 | 12.7–16.0 | 2 | 0.01 | 0.17 |
| 12 | 16.0–20.2 | 0 | 0.00 | 0.00 |
| 13 | 20.2–25.4 | 0 | 0.00 | 0.00 |
| 14 | 25.4–32.0 | 0 | 0.00 | 0.00 |

Preparation of Developer (I):

4 Parts of toner (I) obtained above were thoroughly mixed with a Carrier (I) obtained above were thoroughly mixed with a Turbler (Model T2C) mixer to obtain a two-component developer (I).

Durability Test (I):

The developer (I) (500 g) thus obtained was charged in a developing unit of a copying machine (IMAGIO MF4570 manufactured by Ricoh Company, Ltd.). A total amount of the carrier charged in the developing unit was 480 g. The copying machine was operated under the following conditions:

| | |
|---|---|
| Potential: | |
| Charging potential: | −950 V |
| Development bias: | −600 V |
| Exposure potential: | −150 V |
| Gap between development sleeve and photoconductor drum: | 0.4 mm |
| Gap between development sleeve and developer regulating doctor blade: | 0.4 mm |
| Production of copies: | |
| Chart having image area of 6% (A4 size) | 1,000 sheets |
| Black solid image (A3 size) | 20 sheets |
| Trim image (A3 size) | 3 sheets |
| Chart for evaluating image quality (A3 size) | 3 sheets |

Toner recovery and recycling: by cleaning blade The durability of the developer (I) was evaluated in terms of the change of the toner concentration (percentage of the toner based on the weight of the carrier and the toner) and the change Q/M (Q: quantity of charge, M: mass of toner) relative to the number of copies produced. The results are summarized in Table 2 and FIG. 1. With regard to background stain of the reproduced images, a rank of 5 is the best and a rank of 4 or more is desired.

TABLE 2

| Number of Copies ($\times 10^3$) | Toner Concentration (wt. %) | Q/M (μC/g) | Rank of Background Stain |
|---|---|---|---|
| 0 | 4.18 | 32.1 | 4.5 |
| 30 | 4.40 | 32.4 | 4 |
| 60 | 4.64 | 32.1 | 4 |
| 90 | 4.64 | 32.1 | 4 |
| 120 | 7.54 | 21.7 | 3 |
| 150 | 8.52 | 18.6 | 2 |

As will be appreciated from the results shown in Table 2 and FIG. 1, when about 100,000 copies are produced, background stains are significant. However, since, in the case of the conventional developer composed of a small size toner and a small size carrier, the life time is about 80,000 copies, the carrier of the present invention gives superior results and reduced carrier deposition as compared with the conventional carrier. The gradation, resolution and contrast of the image obtained up to 100,000 copies are excellent. At a later stage of the above duration test, scattering of the toner became significant. The amount of the carrier after production of 150,000 copies was found to be less than 400 g. A considerable increase of the toner concentration after production of about 100,000 copies is presumably attributed to a decrease of the carrier deposition due to deposition thereof onto the photoconductor drum.

Durability Test (II):

The above durability test (I) was repeated in the same manner as described except that the copying machine (IMAGIO MF4570) was modified and provided with a fur brush rotating in the direction opposite to the photoconductor drum. The results are summarized in Table 3 and FIG. 2.

TABLE 3

| Number of Copies ($\times 10^3$) | Toner Concentration (wt. %) | Q/M (μC/g) | Rank of Background Stain |
|---|---|---|---|
| 0 | 4.13 | 30.6 | 4.5 |
| 30 | 3.95 | 29.0 | 4.5 |
| 60 | 4.41 | 23.2 | 4 |
| 90 | 3.90 | 27.2 | 4 |
| 120 | 4.44 | 25.8 | 4 |
| 150 | 3.76 | 33.0 | 4 |
| 180 | 4.44 | 29.5 | 4 |
| 210 | 3.92 | 33.3 | 4 |
| 240 | 4.11 | 31.7 | 4 |
| 270 | 4.04 | 32.9 | 4 |
| 300 | 4.05 | 33.5 | 4 |

Figure 2:
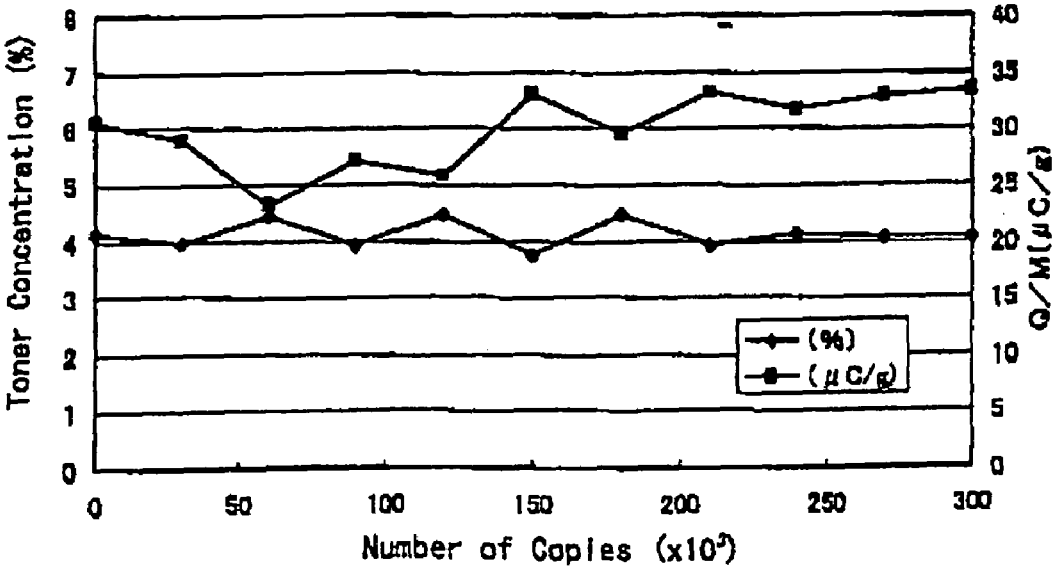
FIG. 2 shows graphs illustrating a relationship between the toner concentration and the number of copies produced and a relationship between Q/M and the number of copies produced in Example 1.

As will be appreciated from the results shown in Table 3 and FIG. 2, the recovery and recycling of the carrier as well as the toner gave significant improve in prevention of background stains throughout the reproduction of 300,000 copies. Substantially no toner scattering was observed. The total amount of the carrier in the developing unit after the reproduction of 300,000 copies was 478 g. In the case of duration test (I), the carrier particles remaining on the photoconductor drum were accumulated in front of the cleaning blade and fell down without being recovered. By using the fur brush, the carrier particles were able to be recovered together with the toner.

Image Evaluation Test:

The developer (I) (500 g) obtained above was charged in a developing unit of a copying machine (IMAGIO MF4570) and tested for various characteristics including image quality and reproducibility of fine line images. The results are summarized in Table 4.

EXAMPLE 2

Preparation of Carrier (II):

| | |
|---|---|
| Ferrite carrier core material (II) shown below | 5000 parts |
| Coating Liquid (I) used in Example 1 | 1220 parts |
| Tin catalyst $(CH_3H_7)_2Sn(OCOCH_3)_2$ (10% toluene solution) | 16.8 parts |

The ferrite core material (II) had a weight average particle diameter of 50 μm, saturation magnetization of 65.5 emu/g, a trace degree residual magnetization, a trace degree of coercive force, an apparent density of 2.48 g/cm$^3$ and fluidity of 27.9 sec/50 g.

The above ferrite carrier core material was placed on a rotary bottom disc of a fluidized bed of a coating device. The disc was rotated to form a vortex. When the vortex was stabilized, Coating Liquid (I) obtained in Example 1 was sprayed into the vortex, The temperature within the coating device was set to 70° C. The resulting coated carrier was heated at 300° C. for 2 hours in an electric oven to obtain Carrier (II) having a specific resistance of $1.5\times10^{13}$ Ω·cm. Carrier (II) contained carbon particles having a number average particle diameter of 0.04 μm.

Preparation of Developer (II):

4 Parts of Toner (I) obtained in Example 1 and 96 parts of Carrier (II) obtained above were thoroughly mixed with a Turbler (Model T2C) mixer to obtain a two-component developer (II).

Durability Test (II):

The durability test (II) of Example 1 was repeated in the same manner as described except that the developer (II) was substituted for the developer (I). Background stains were able to be prevented and good quality images were obtained throughout the reproduction of 300,000 copies. Substantially no toner scattering was observed. A decrease of the amount of carrier was able to be prevented.

Image Evaluation Test:

The developer (II) (500 g) obtained above was charged in a developing unit of a copying machine (IMAGIO MF4570) and tested for various characteristics including image quality and reproducibility of fine line images. The results are summarized in Table 4.

COMPARATIVE EXAMPLE 1

Preparation of Carrier (III);

| | |
|---|---|
| Ferrite carrier core material (I) above | 5000 parts |
| Coating Liquid (I) used in Example 1 | 1220 parts |
| Tin catalyst $(CH_3H_7)_2Sn(OCOCH_3)_2$ (10% toluene solution) | 16.8 parts |

The above ferrite carrier core material was placed on a rotary bottom disc of a fluidized bed of a coating device. The disc was rotated to form a vortex. When the vortex was stabilized, Coating Liquid (I) obtained in Example 1 was sprayed into the vortex. The temperature within the coating device was set to 100° C. The resulting coated carrier was heated at 300° C. for 2 hours in an electric oven to obtain Carrier (III) having a specific resistance of $7.9\times10^{15}$ Ω·cm. Carrier (III) contained carbon particles having a number average particle diameter of 0.007 μm.

Preparation of Developer (III):

4 Parts of Toner (I) obtained in Example 1 and 96 parts of Carrier (III) obtained above were thoroughly mixed with a Turbler (Model T2C) mixer to obtain a two-component developer (III).

Image Evaluation Test:

The developer (III) (500 g) obtained above was charged in a developing unit of a copying machine (IMAGIO MF4570) and tested for various characteristics including image quality and reproducibility of fine line images. The results are summarized in Table 4.

COMPARATIVE EXAMPLE 2

Preparation of Coating Liquid (II) for Carrier;

Dimethylsilicone Resin Having Constituting Units of the Formula (1) Below

| | |
|---|---|
| (toluene solution, solid matter: 20%) | 600 parts |
| Toluene | 600 parts |
| γ-aminotriethoxysilane (KBE903 manufactured by Shin-Etsu Chemical Co., Ltd.) | 9.7 parts |
| Carbon black (BP-2000, manufactured by Cabot Company Ltd.) | 10.2 parts |

(1)

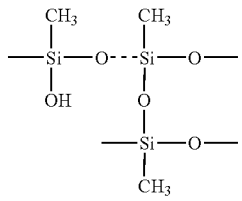

The above components were mixed and thoroughly dispersed with a homomixer (jacket temperature: 35–40° C.) for 5 minutes to obtain Coating Liquid (II) comprising a crosslinked silicone resin.

Preparation of Carrier (IV):

| | |
|---|---|
| Ferrite carrier core material (I) above | 5000 parts |
| Coating Liquid (II) above | 1220 parts |
| Tin catalyst $(CH_3H_7)_2Sn(OCOCH_3)_2$ (10% toluene solution) | 16.8 parts |

The above ferrite carrier core material was placed on a rotary bottom disc of a fluidized bed of a coating device. The disc was rotated to form a vortex. When the vortex was stabilized, Coating Liquid (II) was sprayed into the vortex. The temperature within the coating device was set to 70° C. The resulting coated carrier was heated at 300° C. for 2 hours in an electric oven to obtain Carrier (IV) having a specific resistance of $5.0\times10^{9}$ Ω·cm Carrier (IV) contained carbon particles having a number average particle diameter of 0.16 μm.

Preparation of Developer (IV):

4 Parts of Toner (I) obtained in Example 1 and 96 parts of Carrier (IV) obtained above were thoroughly mixed with a Turbler (Model T2C) mixer to obtain a two-component developer (IV).

Image Evaluation Test:

The developer (IV) (500 g) obtained above was charged in a developing unit of a copying machine (IMAGIO MF4570) and tested for various characteristics including image quality and reproducibility of fine line images. The results are summarized in Table 4.

TABLE 4

| Example No. | Number average particle diameter of carbon (μm) | Specific resistance of carrier (Ω · cm) | Image Density | Rank of reproducibility of fine line image | Others |
|---|---|---|---|---|---|
| 1 | 0.04 | $2.0 \times 10^{13}$ | 1.41 | 4 | no problems |
| 2 | 0.04 | $1.5 \times 10^{13}$ | 1.45 | 5 | no problems |
| Comp. 1 | 0.007 | $7.9 \times 10^{15}$ | 1.19 | 4 | edge effect |
| Comp. 2 | 0.16 | $5.0 \times 10^{9}$ | 1.50 | 3 | white spots |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2001-059113, filed Mar. 2, 2001, inclusive of the specification, claims and drawings, are hereby incorporated by reference herein.

What is claimed is:

1. An image forming method comprising the steps of:

contacting an image forming member bearing an electrostatic latent image thereon with a developer to develop the latent image with the developer to form a toner image on said image forming member;

transferring said toner image to a transfer member;

collecting the toner and the carrier remaining on said image forming member after the transferring step; and recycling the collected toner and the carrier for use in the contacting step;

wherein said developer comprises a dry toner and a carrier said carrier comprising core particles having a weight average particle diameter of 48 to 50 μm, and a resin layer comprising a crosslinked silicone resin; and wherein said resin layer covers each of said core particles and comprises carbon particles thoroughly dispered therein; and wherein said carbon particles have a number average particle diameter of 0.01–0.1 μm.

2. The image forming method of claim 1, wherein said carrier has a weight average particle diameter of 25–65 μm and such a particle diameter distribution that that portion of said carrier having a particle diameter of less than 37 μm but no less than 26 μm accounts for 1–60% of a total weight of said carrier.

3. The image forming method of claim 1, wherein said carrier has a weight average particle diameter of 35–60 μm and such a particle diameter distribution that that portion of said carrier having a particle diameter of less than 37 μm but no less than 26 μm accounts for 10–50% of a total weight of said carrier.

4. The image forming method of claim 1, wherein said carrier has a specific resistance of $10^{9}$–$10^{15}$ Ω·cm.

5. The image forming method of claim 1, wherein said carrier has an induced magnetic moment of 40–85 emu/g in an applied magnetic field of 1 KOe.

* * * * *